US006217957B1

(12) United States Patent
Barnett

(10) Patent No.: US 6,217,957 B1
(45) **Date of Patent: *Apr. 17, 2001**

(54) RECEPTACLE FOR FLORAL-TIPPED BOBBY PINS

(76) Inventor: Gesse Ann Barnett, 2721 Parkview Dr., Thousand Oaks, CA (US) 91362

( * ) Notice: Subject to any disclaimer, the term of this patent is extended or adjusted under 35 U.S.C. 154(b) by 0 days.

This patent is subject to a terminal disclaimer.

(21) Appl. No.: 09/326,094

(22) Filed: Jun. 4, 1999

(51) Int. Cl.[7] ..... A45D 8/02

(52) U.S. Cl. ..... 428/17; 428/24; 428/34.4; 428/35.6; 428/35.7; 47/41.01; 47/47; 204/337; 204/423; 204/524.6

(58) Field of Search ..... 428/35.7, 36.3, 428/361, 17, 19, 24, 25, 15, 34.4; 47/41.01–41.15, 47; 206/337, 423, 524.1, 524.6, 524.3; 422/35.6

(56) References Cited

U.S. PATENT DOCUMENTS 2,420,704 * 5/1947 Gould ..... 206/337
2,466,571 * 4/1949 Bolling, Jr. ..... 206/337
2,602,541 * 7/1952 Otten ..... 206/337
3,654,428 * 4/1972 Talge et al. ..... 392/336
4,192,329 * 3/1980 Swearingen ..... 132/287
5,165,534 * 11/1992 Kaufman et al. ..... 206/739
5,735,295 * 4/1998 Sammon ..... 132/275

* cited by examiner

*Primary Examiner*—Rena L. Dye
(74) *Attorney, Agent, or Firm*—Stetina Brunda Garred & Brucker

(57) ABSTRACT

A decorative receptacle for retaining at least one decorative bobby pin. The decorative bobby pin has opposed first and second ends wherein a decorative element is disposed on the first end thereof. The receptacle further includes a container with an open end in communication with an interior chamber. Disposed within the interior chamber is a quantity of retention material, such as moss. The retention material is adapted to maintain the bobby pin in a substantially vertical orientation upon the advancement of the second end thereinto. Additionally, the retention material maintains the first end of the bobby pin and the decorative element disposed thereon above the open end of the container. Typically, the decorative element attached to the bobby pin is a silk flower and the container is a terra cotta pot. Therefore, when multiple bobby pins are inserted into the pot, a simulated pot or bouquet of flowers is created.

10 Claims, 1 Drawing Sheet

RECEPTACLE FOR FLORAL-TIPPED BOBBY PINS

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to hair accessories and more particularly to a receptacle adapted to retain bobby pins.

Bobby pins are used to pull back and secure hair in a desired position. Typically, the pins are covered by the hair so as not to be seen. The bobby pin is formed from a metallic wire bent in half to form a generally planar portion and a generally undulating portion. The planar portion and the undulating portion are spring biased into laminar juxtaposition with each other by the bend formed in the wire. The exposed ends of the wire are covered with a plastic coating to protect the user during insertion of the bobby pin into the hair. Additionally, one end of the bobby pin is outwardly turned or bent to facilitate insertion of the pin into the hair.

Recently, bobby pins have been made with decorative elements such as silk flowers and/or jewelry to create a more pleasing appearance. The decorative element is attached to the bend in the bobby pin and projects outwardly from the hair when the bobby pin is inserted. Typically, many bobby pins with decorative elements are inserted into the hair at the same time to create artistic designs.

Bobby pins are small and can be lost very easily. Typically, bobby pins are stored in a horizontal position within a drawer, jewelry or cosmetic case. However, bobby pins with decorative elements need to be stored carefully in order to protect the decorative element from damage. Additionally, if the decorative element is a silk flower, then the bobby pin should be stored vertically to prevent crushing and deformation of the silk flower.

The present invention addresses the above-mentioned deficiencies in bobby pin storage by providing a receptacle that stores bobby pins vertically. Additionally, the present invention provides a receptacle that stores bobby pins with decorative elements in an artistically pleasing manner.

BRIEF SUMMARY OF THE INVENTION

In accordance with the present invention there is provided a decorative receptacle for retaining at least one decorative bobby pin in a generally vertical orientation. The decorative bobby pin has opposed first and second ends and a decorative element disposed on the first end thereof. Further, the decorative receptacle includes a container having an interior chamber and an open end which communicates with the interior chamber. A prescribed quantity of retention material is disposed within the interior chamber of the container. The retention material is adapted to maintain the bobby pin in a substantially vertical orientation upon advancement of the second end thereinto. Additionally, the retention material displays the first end including the decorative element thereon exteriorly of the container. Typically, the container is a terra cotta pot and the decorative bobby pins have flowers attached thereto in order to simulate a pot or bouquet of flowers.

The retention material may be moss that comprises individual interwoven strands of material that define a plurality of spaces. A plurality of bobby pins may be inserted into the spaces formed within the strands of moss such that the bobby pins are supported in substantially spaced relationship to one another. Additionally, the strands of moss may be sized such that the bobby pins are attachable to the strands.

In accordance with the preferred embodiment of the present invention, there is provided a method of storing at least one decorative bobby pin within a receptacle having a container filled a retention material. The method comprises inserting the bobby pin within the material such that the bobby pin is supported in a substantially vertical orientation. As will be recognized, a plurality of bobby pins can be inserted into the container at the same time in order to form the simulated pot of flowers.

BRIEF DESCRIPTION OF THE DRAWINGS

These as well as other features of the present invention, will become more apparent upon reference to the drawings wherein.

DETAILED DESCRIPTION OF THE INVENTION

Figure 1:
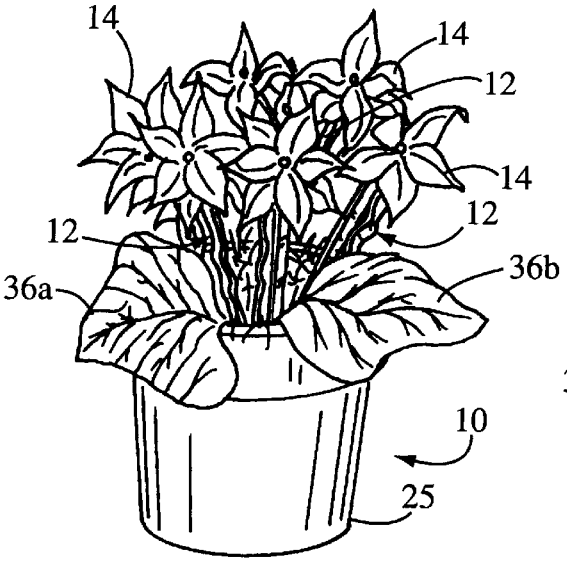
FIG. 1 is a perspective view of a bobby pin receptacle constructed in accordance with the present invention and containing multiple bobby pins.
Figure 2:
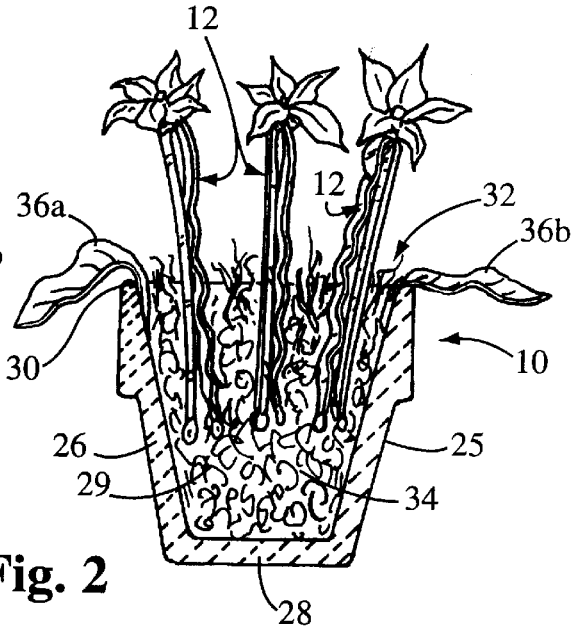
FIG. 2 is a cross-sectional view of the bobby pin receptacle shown in FIG. 1.
Figure 3:
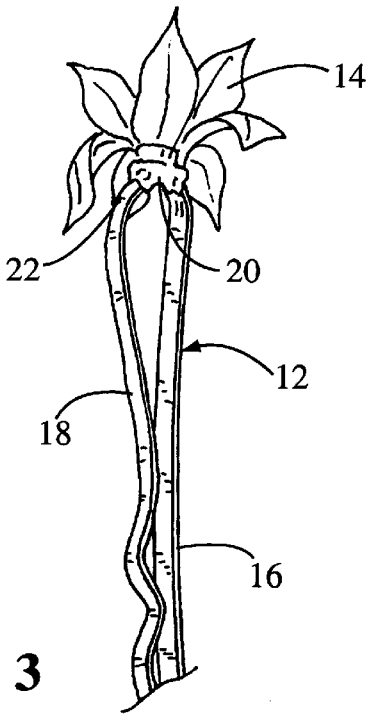
FIG. 3 is a partial perspective view of a bobby pin shown in FIGS. 1 and 2.
Figure 4:
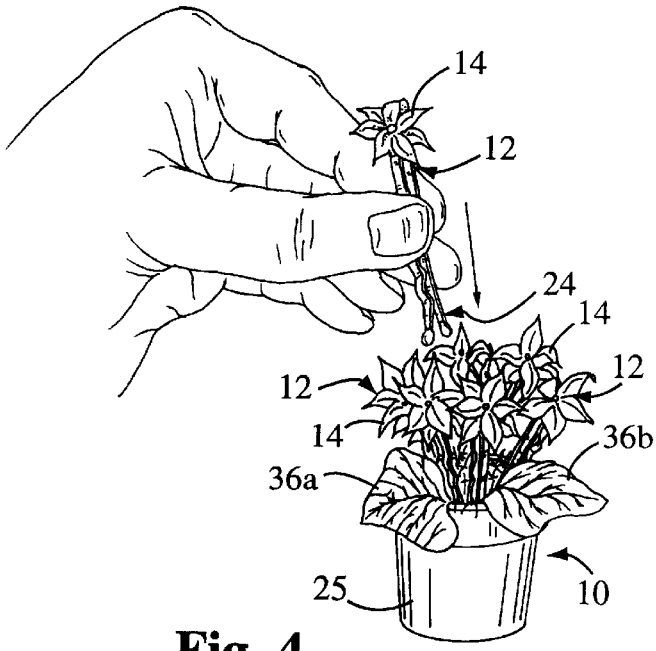
FIG. 4 is a perspective view showing the manner in which a bobby pin is inserted into the bobby pin receptacle.

Referring now to the drawings wherein the showings are for purposes of illustrating a preferred embodiment of the present invention only, and not for purposes of limiting the same, FIG. 1 perspectively illustrates a bobby pin receptacle 10 for storing a plurality of decorative bobby pins 12. Each decorative bobby pin 12 has a decorative element 14 such as a silk flower attached thereto. As seen in FIG. 3, the decorative bobby pin 12 is fabricated by attaching the decorative element 14 to a conventional bobby pin. In this respect, the decorative bobby pin 12 has a generally planar portion 16 and a generally undulating portion 18 integrally attached together via a bent portion 20. The decorative element 14 (i.e., silk flower) is attached to the bent portion 20 with an adhesive 22 and/or a wire wrapped around the bent portion 20. As seen in FIG. 4, the bent portion 20 of the decorative bobby pin 12 is disposed in opposite relation to an open bottom end 24. As will be recognized, the open bottom end 24 is used to insert hair between the side portion 16 and the undulating portion 18.

The bobby pin receptacle 10 comprises a container 25 having a generally tapered, cylindrical side-wall 26 integrally attached to a closed base 28. An upper rim 30 of side-wall 26 defines an open end 32 wherein the decorative bobby pins 12 are inserted into the container 25. The side-wall 26 and the base 28 collectively define an interior chamber 29 wherein access to such is obtained by the open end 32. As will be recognized, the container 25 is typically a terra cotta pot but can also be fabricated from glass, plastic, ceramic or metal.

The bobby pin receptacle 10 additionally includes strands of moss 34 which functions as bobby pin retention material. The strands of moss 34 are formed by interweaving individual strands of flexible material into a random configuration. The strands of moss 34 are disposed within the interior of the container 25 such that voids or spaces are created between the individual strands. The strands of moss 34 may be attached to the interior of container 25 with an adhesive in order to prevent the removal of such. Additionally, a pair of silk leaves 36*a,* 36*b* are adhered to the rim 30 of the container 25 for decorative purposes, as will be further explained below.

The strands of moss 34 are used to secure multiple decorative bobby pins 12 within the container 25. In this respect, the open end 24 of each decorative bobby pin 12 is inserted into the strands of moss 34, as seen in FIG. 4. Each decorative bobby pin 12 is frictionally supported in a substantially vertical position in the spaces formed between the strands of moss 34. Additionally, the strands of moss 34 may also be frictionally gripped between the planar portion 16 and the undulating portion 18 of each decorative bobby pin 12. The strands of moss 34 can therefore support a plurality of decorative bobby pins 12 within the container 25, as seen in FIGS. 1 and 4. Each of the decorative bobby pins 12 is easily removable from the container 25 by pulling the decorative bobby pin 12 away from the moss 34. Since the strands of moss 34 support the decorative bobby pins 12 in generally vertical, spaced relation, the decorative element 14 attached to each bobby pin 12 is protected from crushing and deformation.

Additionally, each decorative bobby pin 12 can be inserted into the container 25 in order to create a simulated pot of flowers which can be displayed. Specifically, since the decorative elements 14 attached to each respective bobby pin 12 may be silk flowers, the decorative bobby pins 12 inserted into the container 25 create a simulated pot or bouquet of flowers. As previously mentioned, a pair of silk leaves 36*a,* 36*b* attached to the container 25 add realism to the simulated bouquet by serving as the leaves of the flowers. Additionally, the strands of moss 34 add realism by serving as the planting medium for the flowers. Therefore, the bobby pin receptacle 10 can be placed on a sink or dresser for display since it is artistically pleasing.

As will be recognized to those of ordinary skill in the art, the decorative elements 14 may be stars, boats, animals, etc . . . , such that the decorative bobby pins 12 have varying themes. Therefore, the container 25 can be fabricated from other types of materials to suite the theme of the decorative bobby pins 12. Additionally, other types of bobby pin retention material may be used such as strands of paper and/or strands of metallic material. Thus, additional modifications and improvements of the present invention may be apparent to those of ordinary skill in the art. The particular combination of parts described and illustrated herein is intended to represent only a certain embodiment of the present invention, and is not intended to serve as limitations of alternative devices within the spirit and scope of the invention.

What is claimed is:

1. A decorative receptacle comprising:

at least on decorative bobby pin having opposed first and second ends and a decorative element disposed on the first end thereof;

a terra cota pot having an interior chamber and an open end which communicates with the interior chamber; and prescribed quantity of retention material disposed within the interior chamber;

the retention material being adapted to maintain the bobby pin in a substantially vertical orientation upon the advancement of the second end thereinto such that the first end including the decorative element thereon is displayed exteriorly of the container.

2. The receptacle of claim 1 wherein the bobby pin retention material is moss.

3. The receptacle of claim 2 wherein the moss is adhered to the container with an adhesive.

4. The receptacle of claim 2 wherein the moss comprises a plurality of interwoven strands that define a plurality of spaces and the bobby pin is insertable into at least one of the spaces.

5. The receptacle of claim 4 wherein the strands of moss are sized to be insertable into the bobby pin.

6. The receptacle of claim 1 comprising a plurality of bobby pins.

7. A method of storing at least one decorative bobby pin having opposed first and second ends and a decorative element disposed on the first end thereof, in a container filled with a moss retention material, the method comprising the step of inserting the second end of the bobby pin within the moss such that the bobby pin is in a substantially vertical orientation and the first end including the decorative element thereon is displayed exteriorly of the container.

8. The method of claim 7 wherein the at least one decorative bobby pin comprises a plurality of decorative bobby pins.

9. A decorative receptacle for retaining at least one decorative bobby pin in a substantially vertical orientation, the receptacle comprising:

a terra cota pot having an interior chamber and an open end which communicates with the interior chamber; and a prescribed quantity of moss disposed within the interior chamber of the container and configured to support the bobby pin in a substantially vertical orientation.

10. The decorative receptacle of claim 9 comprising a plurality of bobby pins insertable into the retention material.

* * * * *